US009394752B2

(12) United States Patent
Fleming et al.

(10) Patent No.: US 9,394,752 B2
(45) Date of Patent: Jul. 19, 2016

(54) COMPLETION METHOD FOR STIMULATION OF MULTIPLE INTERVALS

(75) Inventors: John Fleming, Damon, TX (US); Gary L. Rytlewski, League City, TX (US); Larry W. Phillips, Angleton, TX (US); Jason Swaren, Sugar Land, TX (US); Aude Faugere, Houston, TX (US); Rod Shampine, Houston, TX (US); Zhanke Liu, Sugar Land, TX (US); Pete Bazan, Jr., Friendswood, TX (US); Jabus Talton Davis, Katy, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 752 days.

(21) Appl. No.: 13/291,272

(22) Filed: Nov. 8, 2011

(65) Prior Publication Data

US 2013/0112435 A1 May 9, 2013

(51) Int. Cl.

| | |
|---|---|
| ***E21B 34/14*** | (2006.01) |
| ***E21B 23/00*** | (2006.01) |
| ***E21B 43/14*** | (2006.01) |
| ***E21B 43/26*** | (2006.01) |

(52) U.S. Cl.

CPC ..... *E21B 23/006* (2013.01); *E21B 34/14* (2013.01); *E21B 43/14* (2013.01); *E21B 43/26* (2013.01)

(58) Field of Classification Search

CPC ..... E21B 34/14
USPC ..... 166/386, 373, 381, 318–320, 331, 166/332.4, 242.1
See application file for complete search history.

(56) References Cited

U.S. PATENT DOCUMENTS

| | | | | |
|---|---|---|---|---|
| 2,716,454 | A * | 8/1955 | Abendroth | 166/308.1 |
| 3,011,548 | A | 12/1961 | Holt | |
| 3,054,415 | A | 9/1962 | Baker et al. | |
| 3,263,752 | A | 8/1966 | Conrad | |
| 3,269,463 | A | 8/1966 | Page, Jr. | |
| 3,995,692 | A | 12/1976 | Seitz | |
| 4,064,937 | A | 12/1977 | Barrington | |
| 4,355,686 | A | 10/1982 | Arendt | |
| 4,729,432 | A | 3/1988 | Helms | |

(Continued)

FOREIGN PATENT DOCUMENTS

| | | | |
|---|---|---|---|
| WO | 03095794 | A1 | 11/2003 |
| WO | 2004088091 | A1 | 10/2004 |

OTHER PUBLICATIONS

Thomson, D. W., and Nazroo, M. F., Design and Installation of a Cost-Effective Completion System for Horizontal Chalk Wells Where Multiple Zones Require Acid Stimulation, SPE 51177 (a revision of SPE 39150), Offshore Technology Conference, May 1997, Houston, TX, USA.

(Continued)

*Primary Examiner* — David Bagnell
*Assistant Examiner* — Ronald Runyan
(74) *Attorney, Agent, or Firm* — Jeffery R. Peterson

(57) ABSTRACT

A technique provides for stimulating or otherwise treating multiple intervals/zones of a well by controlling flow of treatment fluid via a plurality of flow control devices. The flow control devices are provided with internal profiles and flow through passages. Mechanical darts are designed for engagement with the internal profiles of specific flow control devices, and each mechanical dart may be moved downhole for engagement with and activation of the specific flow control device associated with that mechanical dart.

17 Claims, 8 Drawing Sheets

(56) References Cited

U.S. PATENT DOCUMENTS

| | | | | |
|---|---|---|---|---|
| 4,771,831 | A | 9/1988 | Pringle et al. | |
| 4,949,788 | A * | 8/1990 | Szarka et al. | 166/285 |
| 5,183,114 | A | 2/1993 | Mashaw, Jr. et al. | |
| 5,224,044 | A | 6/1993 | Tamura et al. | |
| 5,295,393 | A | 3/1994 | Thiercelin | |
| 5,333,692 | A | 8/1994 | Baugh et al. | |
| 5,526,888 | A | 6/1996 | Gazewood | |
| 5,921,318 | A | 7/1999 | Ross | |
| 5,988,285 | A | 11/1999 | Tucker et al. | |
| 6,006,838 | A | 12/1999 | Whiteley et al. | |
| 6,059,032 | A | 5/2000 | Jones | |
| 6,155,342 | A | 12/2000 | Oneal et al. | |
| 6,206,095 | B1 | 3/2001 | Baugh | |
| 6,216,785 | B1 | 4/2001 | Achee, Jr. et al. | |
| 6,302,199 | B1 | 10/2001 | Hawkins et al. | |
| 6,334,486 | B1 | 1/2002 | Carmody et al. | |
| 6,371,208 | B1 | 4/2002 | Norman et al. | |
| 6,443,228 | B1 | 9/2002 | Aronstam et al. | |
| 6,543,538 | B2 | 4/2003 | Tolman et al. | |
| 6,634,429 | B2 | 10/2003 | Henderson et al. | |
| 6,907,936 | B2 | 6/2005 | Fehr et al. | |
| 6,997,263 | B2 | 2/2006 | Campbell et al. | |
| 7,066,265 | B2 | 6/2006 | Surjaatmadja | |
| 7,093,664 | B2 | 8/2006 | Todd et al. | |
| 7,108,067 | B2 | 9/2006 | Themig et al. | |
| 7,134,505 | B2 | 11/2006 | Fehr et al. | |
| 7,168,494 | B2 | 1/2007 | Starr et al. | |
| 7,210,533 | B2 | 5/2007 | Starr et al. | |
| 7,322,417 | B2 | 1/2008 | Rytlewski et al. | |
| 7,325,617 | B2 | 2/2008 | Murray | |
| 7,353,879 | B2 | 4/2008 | Todd et al. | |
| 7,377,321 | B2 | 5/2008 | Rytlewski | |
| 7,387,165 | B2 | 6/2008 | Lopez de Cardenas et al. | |
| 7,431,091 | B2 | 10/2008 | Themig et al. | |
| 7,464,764 | B2 | 12/2008 | Xu | |
| 7,490,669 | B2 | 2/2009 | Walker et al. | |
| 7,543,634 | B2 | 6/2009 | Fehr et al. | |
| 7,543,647 | B2 | 6/2009 | Walker | |
| 7,552,779 | B2 | 6/2009 | Murray | |
| 7,571,765 | B2 | 8/2009 | Themig | |
| 7,575,062 | B2 | 8/2009 | East, Jr. | |
| 7,661,481 | B2 | 2/2010 | Todd et al. | |
| 7,748,460 | B2 | 7/2010 | Themig et al. | |
| 7,832,472 | B2 | 11/2010 | Themig | |
| 7,891,774 | B2 | 2/2011 | Silverbrook | |
| 2001/0045290 | A1 * | 11/2001 | Pringle et al. | 166/386 |
| 2002/0074128 | A1 | 6/2002 | Allamon | |
| 2003/0180094 | A1 | 9/2003 | Madison | |
| 2004/0118564 | A1 | 6/2004 | Themig et al. | |
| 2004/0262016 | A1 | 12/2004 | Farquhar | |
| 2006/0124310 | A1 | 6/2006 | Lopez de Cardenas et al. | |
| 2006/0207764 | A1 | 9/2006 | Rytlewski | |
| 2006/0243455 | A1 | 11/2006 | Telfer et al. | |
| 2007/0044958 | A1 | 3/2007 | Rytlewski et al. | |
| 2007/0107908 | A1 | 5/2007 | Vaidya et al. | |
| 2007/0181224 | A1 | 8/2007 | Marya et al. | |
| 2007/0272411 | A1 | 11/2007 | Lopez de Cardenas | |
| 2007/0272413 | A1 | 11/2007 | Rytlewski et al. | |
| 2007/0284097 | A1 | 12/2007 | Swor et al. | |
| 2008/0105438 | A1 | 5/2008 | Jordan et al. | |
| 2008/0210429 | A1 | 9/2008 | McMillin et al. | |
| 2010/0101803 | A1 | 4/2010 | Clayton et al. | |
| 2010/0132954 | A1 | 6/2010 | Telfer | |
| 2010/0209288 | A1 | 8/2010 | Marya | |
| 2011/0056692 | A1 | 3/2011 | Lopez de Cardenas et al. | |
| 2011/0127047 | A1 | 6/2011 | Themig et al. | |
| 2011/0240301 | A1 | 10/2011 | Robison | |
| 2011/0240311 | A1 | 10/2011 | Robison | |
| 2011/0278010 | A1 | 11/2011 | Fehr et al. | |
| 2012/0085538 | A1 | 4/2012 | Guerrero et al. | |
| 2013/0081827 | A1 * | 4/2013 | Etzel | 166/386 |

OTHER PUBLICATIONS

Lonnes, S. B., Nygaard, K. J., Sorem, W. A., Hall, T. J., Tolman, R. C., Advanced Multizone Stimulation Technology, SPE 95778, Presented at the 2005 SPE Annual Technical Conference and Exhibition, Oct. 9-12, 2005, Dallas, TX, USA.

Rytlewski, G., Multiple-Layer Commpletions for Efficient Treatment of Multilayer Reservoirs, IADC/SPE 112476, Presented at the 2008 IADC/SPE Drilling Conference, Mar. 4-6, 2008, Orlando, FL, USA.

* cited by examiner

COMPLETION METHOD FOR STIMULATION OF MULTIPLE INTERVALS

BACKGROUND

Hydrocarbon fluids are obtained from subterranean geologic formations, referred to as reservoirs, by drilling wells that penetrate the hydrocarbon-bearing formations. In some applications, a well is drilled through multiple well zones and each of those well zones may be treated to facilitate hydrocarbon fluid productivity. For example, a multizone vertical well or horizontal well may be completed and stimulated at multiple injection points along the well completion to enable commercial productivity. The treatment of multiple zones can be achieved by sequentially setting bridge plugs through multiple well interventions. In other applications, drop balls are used to open sliding sleeves at sequential well zones with size-graduated drop balls designed to engage seats of progressively increasing diameter.

SUMMARY

In general, the present disclosure provides a methodology and system for stimulating or otherwise treating multiple intervals/zones of a well by controlling flow of treatment fluid via a plurality of flow control devices. The flow control devices are provided with internal profiles and flow through passages. Mechanical darts are designed for engagement with the internal profiles of specific flow control devices, and each mechanical dart may be moved downhole for engagement with and activation of the specific flow control device associated with that mechanical dart.

BRIEF DESCRIPTION OF THE DRAWINGS

Certain embodiments will hereafter be described with reference to the accompanying drawings, wherein like reference numerals denote like elements. It should be understood, however, that the accompanying figures illustrate only the various implementations described herein and are not meant to limit the scope of various technologies described herein, and.

DETAILED DESCRIPTION

In the following description, numerous details are set forth to provide an understanding of some illustrative embodiments of the present disclosure. However, it will be understood by those of ordinary skill in the art that the system and/or methodology may be practiced without these details and that numerous variations or modifications from the described embodiments may be possible.

The disclosure herein generally relates to a system and methodology which facilitate multi-zonal completion and treatment of a well. For example, the methodology may comprise completing multizone vertical wells and/or horizontal wells that benefit from stimulation at multiple injection points along the wellbore to achieve commercial productivity. The individual well zones can be subjected to a variety of well treatments to facilitate production of desired hydrocarbon fluids, such as oil and/or gas. The well treatments may comprise stimulation treatments, such as fracturing treatments, performed at the individual well zones. However, a variety of other well treatments may be employed utilizing various types of treatment materials, including fracturing fluid, proppant materials, slurries, chemicals, and other treatment materials designed to enhance the productivity of the well. The present approach to multi-zonal completion and treatment reduces completion cycle times, increases or maintains completion efficiency, improves well productivity, and increases recoverable reserves.

Also, the well treatments may be performed in conjunction with many types of well equipment deployed downhole into the wellbore. For example, various completions may employ a variety of flow control devices which are used to control the lateral flow of fluid out of and/or into the completion at the various well zones. In some applications, the flow control devices are mounted along a well casing to control the flow of fluid between an interior and exterior of the well casing. However, flow control devices may be positioned along internal tubing or along other types of well strings/tubing structures deployed in the wellbore. The flow control devices may comprise sliding sleeves, valves, and other types of flow control devices which may be actuated by a member dropped down through the tubular structure.

Figure 1:
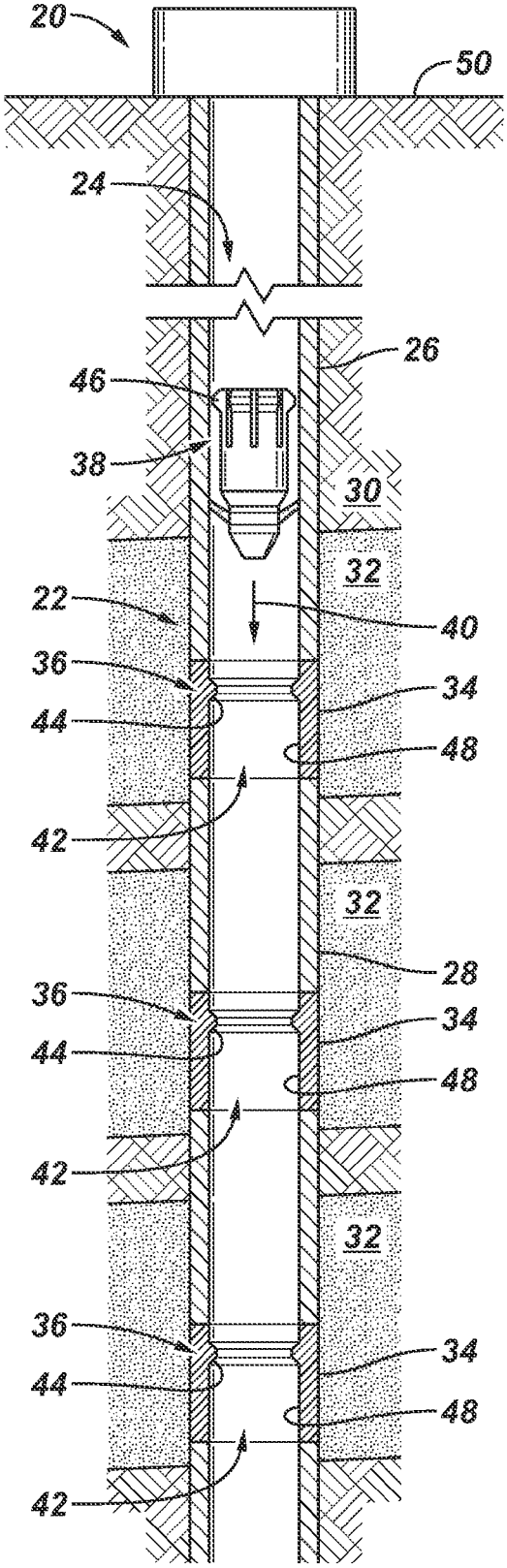
FIG. 1 is a schematic illustration of an example of a well system comprising a plurality of flow control devices that may be selectively actuated, according to an embodiment of the disclosure.

Referring generally to FIG. 1, an example of one type of application utilizing a plurality of flow control devices is illustrated. The example is provided to facilitate explanation, and it should be understood that a variety of well completion systems and other well or non-well related systems may utilize the methodology described herein. The flow control devices may be located at a variety of positions and in varying numbers along the tubular structure depending on the number of external zones to be treated.

In FIG. 1, an embodiment of a well system 20 is illustrated as comprising downhole equipment 22, e.g. a well completion, deployed in a wellbore 24. The downhole equipment 22 may be part of a tubing string or tubular structure 26, such as well casing, although the tubular structure 26 also may comprise many other types of well strings, tubing and/or tubular devices. Additionally, downhole equipment 22 may include a variety of components, depending in part on the specific application, geological characteristics, and well type. In the example illustrated, the wellbore 24 is substantially vertical and tubular structure 26 comprises a casing 28. However, various well completions and other embodiments of downhole equipment 22 may be used in a well system having other types of wellbores, including deviated, e.g. horizontal, single bore, multilateral, cased, and uncased (open bore) wellbores.

In the example illustrated, wellbore 24 extends down through a subterranean formation 30 having a plurality of well zones 32. The downhole equipment 22 comprises a plurality of flow control devices 34 associated with the plurality of well zones 32. For example, an individual flow control device 34 may control flow from tubular structure 26 into the surrounding well zone 32 or vice versa. In some applications, a plurality of flow control devices 34 may be associated with each well zone 32. By way of example, the illustrated flow control devices 34 may comprise sliding sleeves, although other types of valves and devices may be employed to control the lateral fluid flow.

As illustrated, each flow control device 34 comprises a seat member 36 designed to engage a dart 38 which is dropped down through tubular structure 26 in the direction illustrated by arrow 40. Each dropped dart 38 may be mechanically programmed/pre-set or designed to engage a specific seat member 36 of a specific flow control device 34 to enable actuation of that specific flow control device 34. However, engagement of the dart 38 with the specific, corresponding seat member 36 is not dependent on matching the diameter of the seat member 36 with a diameter of the dart 38. In the embodiment of FIG. 1, for example, the plurality of flow control devices 34 and their corresponding seat members 36 may be formed with longitudinal flow through passages 42 having diameters which are of common size. This enables maintenance of a relatively large flow passage through the tubular structure 26 across the multiple well zones 32.

In the example illustrated, each seat member 36 comprises a profile 44, such as a lip, ring, unique surface feature, recess, or other profile which is designed to engage a corresponding engagement feature 46 of the dart 38. By way of example, the profile 44 may be formed in a sidewall 48 of seat member 36, the sidewall 48 also serving to create longitudinal flow through passage 42. In some applications, the engagement feature 46 is coupled to an indexing mechanism which indexes each time dart 38 passes through one of the flow control devices 34. The indexing mechanism may be mechanically programmed to actuate the engagement feature 46 for engagement with a corresponding profile 44 after a predetermined number of indexing motions, e.g. after passage through a predetermined number of flow control devices 34.

Figure 2:
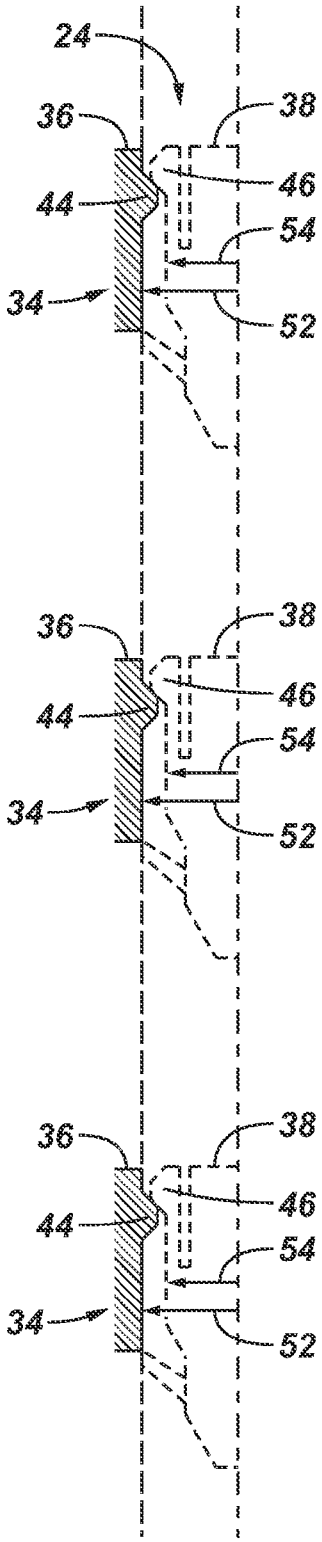
FIG. 2 is a schematic illustration of flow control devices engaged by corresponding mechanical darts, according to an embodiment of the disclosure.

Referring generally to FIG. 2, a schematic example of a system and methodology for treating multiple well zones is illustrated. In this example, each flow control device 34 is actuated by movement of the seat member 36 once engaged by a corresponding dart 38. Each seat member 36 comprises profile 44 which can be engaged selectively by actuating the engagement feature 46 of dart 38 after dart 38 is delivered downhole from a surface location 50 (see FIG. 1). Because seating of the dart 38 is not dependent on decreasing seat diameters, a diameter 52 of each flow through passage 42 may be the same from one seat member 36 to the next. This enables construction of darts 38 having a common diameter 54 when in a radially contracted configuration during movement down through tubular structure 26 prior to actuation of the engagement feature 46.

In one example of a multizone treatment operation, the darts 38 are mechanically programmed or designed to actuate and engage the seat members 36 sequentially starting at the lowermost or most distal flow control device 34. The dart 38 initially dropped passes down through flow control devices 34 until the engagement feature 46 is actuated radially outwardly into engagement with the profile 44 of the lowermost seat member 36 illustrated in the example of FIG. 2. It should be noted that in some embodiments, darts 38 may utilize unique engagement features designed to match corresponding profiles 44 of seat member 36. Once the initial dart 38 is seated in the distal seat member 36, pressure is applied through the tubular structure 26 and against the dart 38 to transition the seat member 36 and the corresponding flow control device 34 to a desired operational configuration. For example, the flow control device 34 may comprise a sliding sleeve which is transitioned to an open flow position to enable outward flow of a fracturing treatment or other type of treatment into the surrounding well zone 32.

After the initial well zone is treated, a subsequent dart 38 is dropped down through the flow through passages 42 of the upper flow control device or devices until the engagement feature 46 is actuated outwardly into engagement with the next sequential profile 44 of the next sequential flow control device 34. Pressure may then again be applied down through the tubular structure 26 to transition the flow control device 34 to a desired operational configuration which enables application of a desired treatment at the surrounding well zone 32. A third dart 38 may then be dropped for actuation and engagement with the seat member 36 of the third flow control device 34 to enable actuation of the third flow control device and treatment of the surrounding well zone. This process may be repeated as desired for each additional flow control device 34 and well zone 32. Depending on the application, a relatively large number of darts 38 is easily deployed to enable actuation of specific flow control devices along the wellbore 24 for the efficient treatment of multiple well zones.

The methodology may be used in cemented or open-hole completion operations, and darts 38 are used as free fall and/or pump-down darts to selectively engage and operate sliding sleeves or other types of flow control devices 34. Additionally, the darts 38 may be designed to enable immediate flow back independent of chemical processes or milling to remove plugs. In open-hole applications, hydraulic set external packers or swellable packers may be used to isolate well zones along wellbore 24.

In one example of an application, the flow control devices 34 are sliding sleeve valves which are initially run-in-hole with the casing 28 to predetermined injection point depths for a fracture stimulation. A casing cementation operation is then performed utilizing, for example, standard materials and procedures. In open-hole applications, open-hole packers may be used instead of cementation. Prior to fracture stimulation, a pressure activated sliding sleeve valve set opposite the deepest injection point is opened or, alternatively, this interval can be perforated using a variety of perforating techniques. In other applications, the sliding sleeve valve at the deepest injection point may be opened via the initial dart 38.

After creating the desired opening or openings at the deepest injection point, fracture treatment fluid is pumped into this first interval. During a treatment flush, a dart 38 is pumped down and this initial dart is pre-set, e.g. mechanically preprogrammed, to engage a specific sliding sleeve 34. In some applications, the first interval may not be fracture treated but instead used to allow pumping down the first dart 38. When the dart 38 engages, fluid is pumped to increase pressure until the sliding sleeve 34 shifts to an open position. At this stage, the fracture treatment fluid is pumped downhole and into the surrounding well zone 32. This process of launching darts 38 in the treatment flush is continued until all of the intervals/well zones 32 are treated. The well may be flowed back immediately or shut-in for later flow back. The darts 38 may later be removed via milling, dissolving, or through other suitable techniques to restore the unrestricted internal diameter of the casing.

Figure 3:
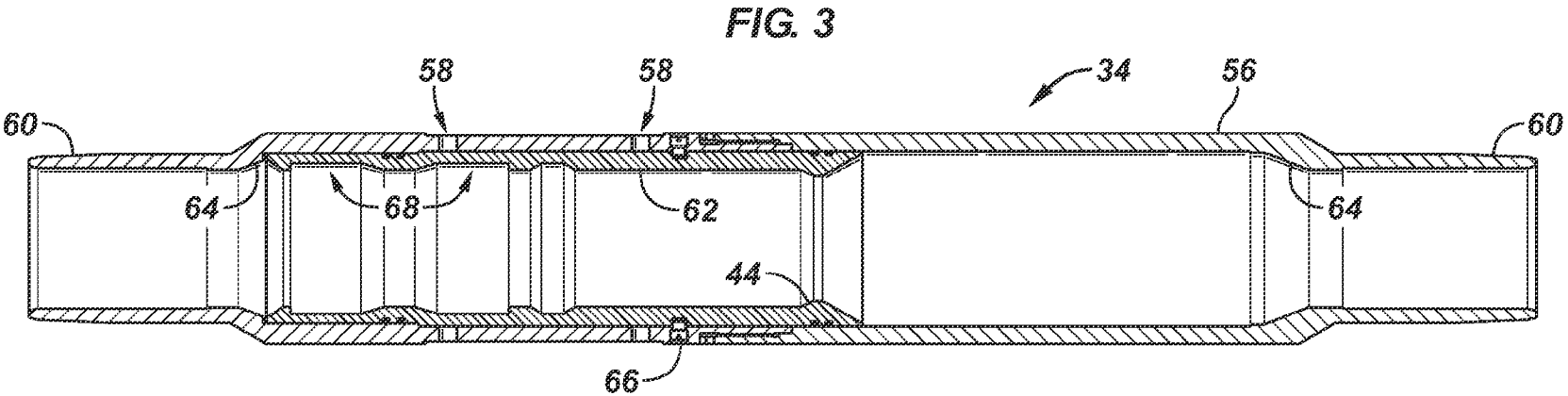
FIG. 3 is a cross-sectional view of an example of a flow control device structured as a sliding sleeve, according to an embodiment of the disclosure.

The flow control devices 34 may comprise a variety of devices, including sliding sleeves. One example of a flow control device/sliding sleeve valve 34 is illustrated in FIG. 3. In this embodiment, the sliding sleeve valve 34 comprises a ported housing 56 designed for running into the well with the casing 28. The housing 56 comprises at least one flow port 58 to enable radial or lateral flow through the housing 56 between an interior and an exterior of the housing. The housing 56 also may comprise end connections 60, e.g. casing connections, for coupling the housing 56 to the casing 28 or to another type of tubular structure 26.

In the embodiment illustrated, seat member 36 is in the form of a sliding sleeve 62 slidably positioned along an interior surface of the housing 56 between containment features 64. During movement downhole, the sliding sleeve 62 may be held in a position covering flow ports 58 by a retention member 66, such as a shear screw. The sliding sleeve 62 further comprises profile 44 designed to engage the engagement feature 46 of a dart 38 when the engagement feature 46 is in an actuated position. In some applications, the sliding sleeve 62 may comprise a secondary profile 68 designed to engage, for example, a suitable shifting tool. The secondary profile 68 provides an alternative way to open or close the sliding sleeve valve 34. When a designated dart 38 is engaged with profile 44 via engagement feature 46, application of pressure against the dart 38 causes retention member 66 to shear or otherwise release, thus allowing sliding sleeve 62 to transition along the interior of housing 56 until ports 58 are opened to lateral fluid flow. The seated dart 38 also isolates the casing volume below the sliding sleeve valve 34.

Figure 4:
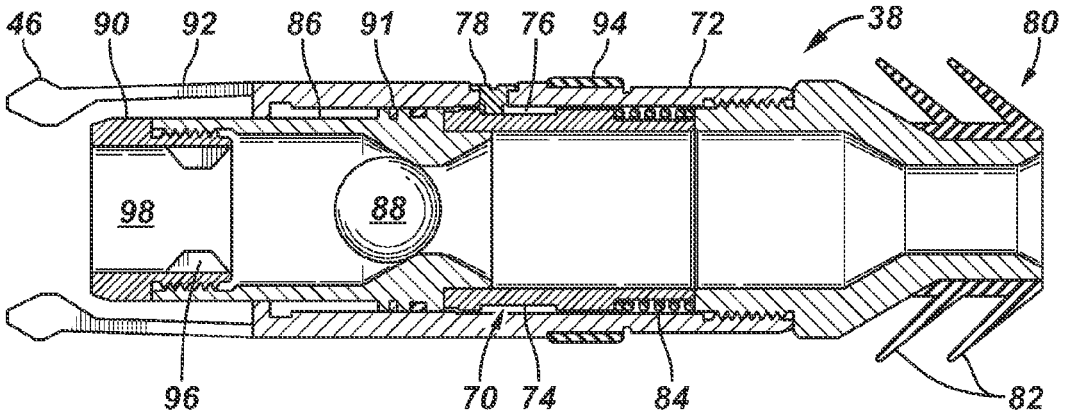
FIG. 4 is a cross-sectional view of an example of a mechanical dart, according to an embodiment of the disclosure.
Figure 5:
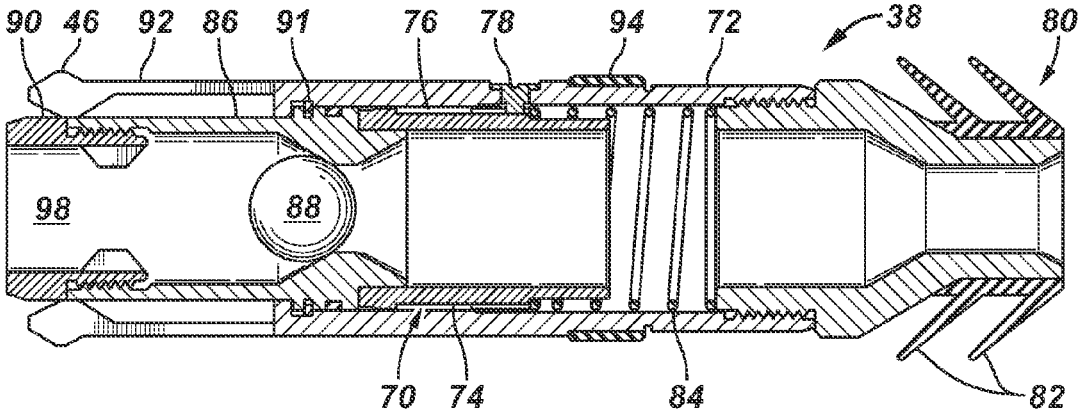
FIG. 5 is a cross-sectional view of the mechanical dart illustrated in FIG. 4 but in a different operational position, according to an embodiment of the disclosure.

Referring generally to FIGS. 4 and 5, an embodiment of dart 38 is illustrated. In this embodiment, the dart 38 may be pre-set, e.g. mechanically preprogrammed, at the surface to engage a specific sliding sleeve 62 or other type of seat member 36. The illustrated dart 38 comprises an indexing mechanism 70 which is designed to increment each time the dart 38 traverses a flow control device/sliding sleeve valve 34 until the indexing mechanism 70 has been cycled a predetermined number of increments. At this stage, the indexing mechanism 70 automatically actuates the engagement feature 46 prior to engaging and seating against the next sequential profile 44.

In the example illustrated, dart 38 comprises a dart housing 72 containing indexing mechanism 70. Indexing mechanism 70 may comprise an indexing sleeve 74, e.g. an indexing rotor, slidably mounted within dart housing 72 and including slots 76, e.g. J-slots, which transition the indexing mechanism 70 to subsequent incremental positions each time the indexing sleeve 74 is translated back and forth linearly. An indexing pin 78 extends inwardly from dart housing 72 and engages slots 76 to force transition of the indexing mechanism 70 from one incremental position to the next.

The dart 38 further comprises a lead end 80 having flexible abutment features 82 designed to temporarily engage the profile 44 at each flow control device 34. When profile 44 is temporarily engaged, application of additional pressure against dart 38 causes the indexing sleeve 74 to transition linearly in one direction along dart housing 72 and a spring member 84 may be used to cause transition of the indexing sleeve 74 in an opposite direction, thus incrementing the indexing activism 70 to the next position. Until the indexing mechanism 70 has been incremented the pre-set number of cycles, however, the engagement member 46 is not actuated to an engagement position. This allows the dart 38 to be moved, e.g. pushed, through the profile 44 toward the next adjacent flow control device 34. In the example illustrated, indexing sleeve 74 is moved against spring member 84 by an annular member 86 acted on by a ball 88 or similar device. The ball 88 and annular member 86 also serve as a check valve by enabling buildup of pressure in one direction while allowing flow back in an opposite direction.

Once the indexing mechanism 70 has been incrementally indexed a predetermined number of times, the indexing sleeve 74 and annular member 86 are released so that the spring member 84 may move a locking member 90, e.g. a locking ring, to actuate engagement member 46 into a radially outward, locked position, as illustrated in FIG. 5. Once in the radially outward, locked position, engagement member 46 is not able to pass through the next adjacent profile 44. This causes the engagement member 46 to seat against the next adjacent profile 44 of the desired flow control device 34. A locking feature 91, e.g. a locking ring, also may be employed to lock annular member 86 in the locked position illustrated in FIG. 5. By way of further example, engagement feature 46 may be mounted on a collet 92 which, in turn, is coupled to or formed as part of dart housing 72.

Depending on the specific application, darts 38 may comprise additional or alternate features. For example, each dart 38 may comprise an external seal packing 94 designed and positioned to seal against a corresponding seal surface in the sliding sleeve valve 34 when the collet 92 and engagement member 46 are in the actuated position. Each dart 38 also may comprise a retainer feature 96 positioned to retain the ball or other sealing device 88 within an interior flow passage 98 of the dart 38. The indexing mechanism 70 also may comprise the indexing sleeve 74 in a form having one or more multi-cycle J-slots.

The darts 38 also may be formed from a variety of materials. In many applications, the darts are not subjected to abrasive flow, so the darts 38 may be constructed from a relatively soft material, such as aluminum. In a variety of applications, the darts 38 also may be formed from degradable, e.g. dissolvable, materials which simply degrade over a relatively short period of time following performance of the well treatment operation at the surrounding well zone 32. Upon sufficient degradation, the dart 38 can simply drop through the corresponding flow control device 34 to allow production fluid flow, or other fluid flows, along the interior of the tubular structure 26. However, post-stimulation removal of the darts 38 to restore full-bore or near full-bore casing access may be achieved by a variety of techniques, including flow back, milling, dissolving, pushing to the bottom, or pulling to the surface.

Figure 6:
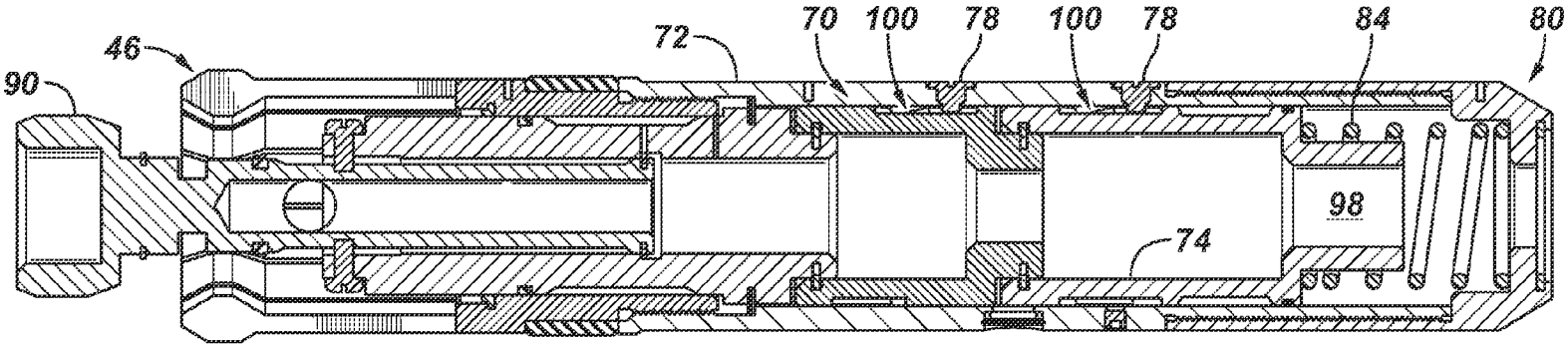
FIG. 6 is a cross-sectional view of an alternate example of a mechanical dart, according to an embodiment of the disclosure.
Figure 7:
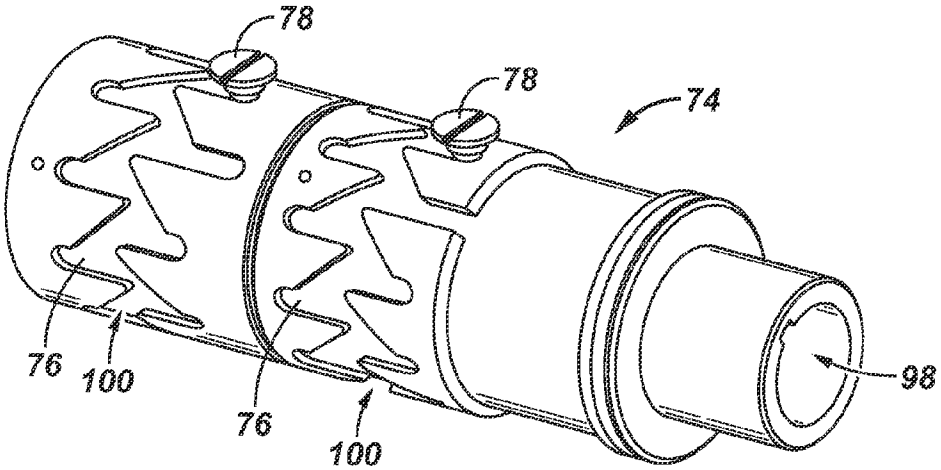
FIG. 7 is an illustration of a portion of an indexing mechanism which may be used in the mechanical dart illustrated in FIG. 6, according to an embodiment of the disclosure.

Depending on the environment, parameters of the treatment operation, and number of flow control devices 34, the design of indexer 70 may vary to accommodate the specifics of a given application. In the embodiment described with reference to FIGS. 4 and 5, for example, dart 38 comprises indexing mechanism 70 in the form of a single J-slot indexer. In the embodiment illustrated in FIGS. 6 and 7, however, the indexer 70 comprises a plurality of multi-cycle J-slots. In this latter example, the indexing mechanism 70 employs indexing sleeve 74 in the form of a rotor with a plurality of multi-cycle J-slot mechanisms 100. The multi-cycle J-slot mechanisms comprise slots 76 which interact with a plurality of corresponding indexing pins 78. FIG. 7 illustrates an example of one type of indexing sleeve 74 incorporating a pair of multi-cycle, J-slot mechanisms 100.

Figure 8:
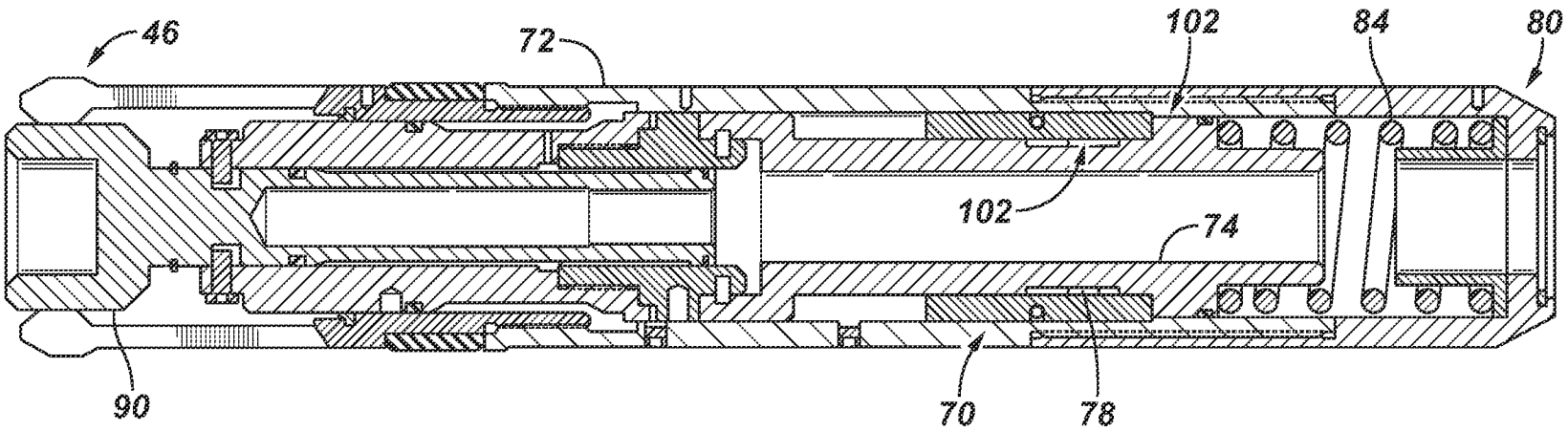
FIG. 8 is a cross-sectional view of an alternate example of a mechanical dart, according to an embodiment of the disclosure.
Figure 9:
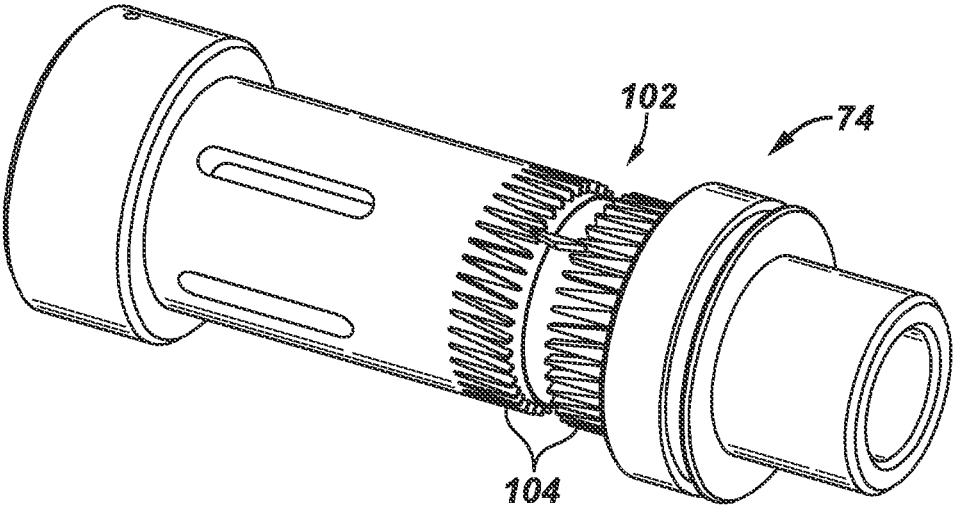
FIG. 9 is an illustration of a portion of an indexing mechanism which may be used in the mechanical dart illustrated in FIG. 8, according to an embodiment of the disclosure.

In an alternate embodiment, indexing mechanism 70 utilizes a spline tooth indexer design. As illustrated in FIGS. 8 and 9, indexing mechanism 70 comprises a spline tooth mechanism 102 which utilizes rotors having opposed rows of cooperating teeth 104 to sequentially ratchet the indexing mechanism 70 from one incremental position to another, as illustrated in FIG. 9. A variety of spline tooth mechanisms 102 may be used in various styles of mechanical dart 38 to enable pre-setting the dart to actuate engagement feature 46 for seating against the corresponding profile 44 in the desired flow control device 34.

Figure 10:
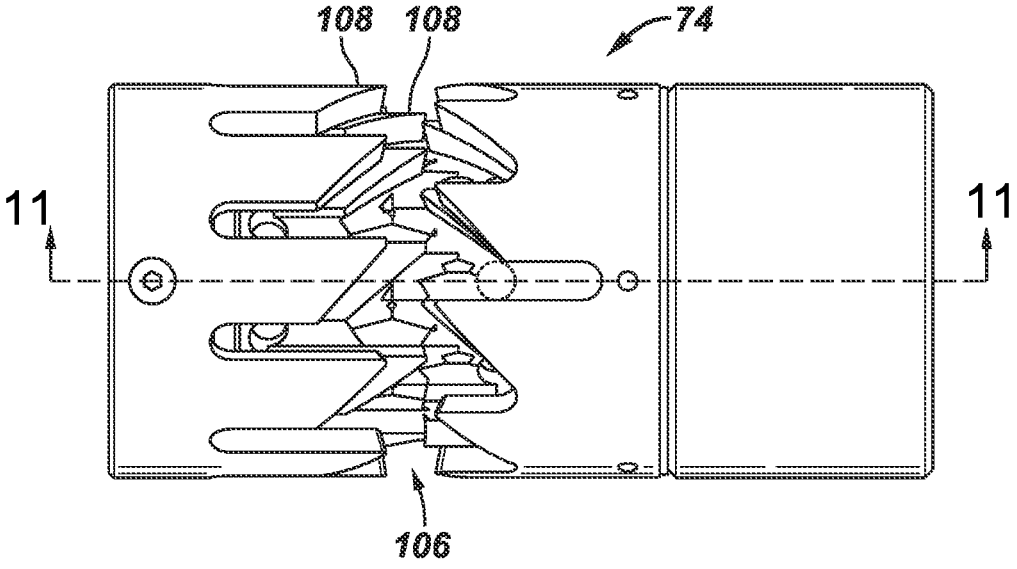
FIG. 10 is a front view of an alternate indexing mechanism which may be used in a mechanical dart, according to an embodiment of the disclosure.
Figure 11:
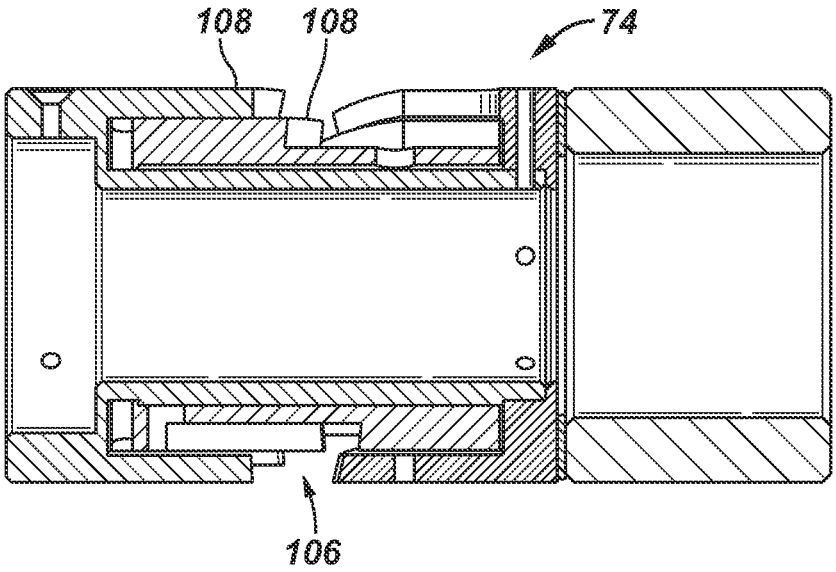
FIG. 11 is a cross-sectional view of the alternate indexing mechanism illustrated in FIG. 10, according to an embodiment of the disclosure.
Figure 12:
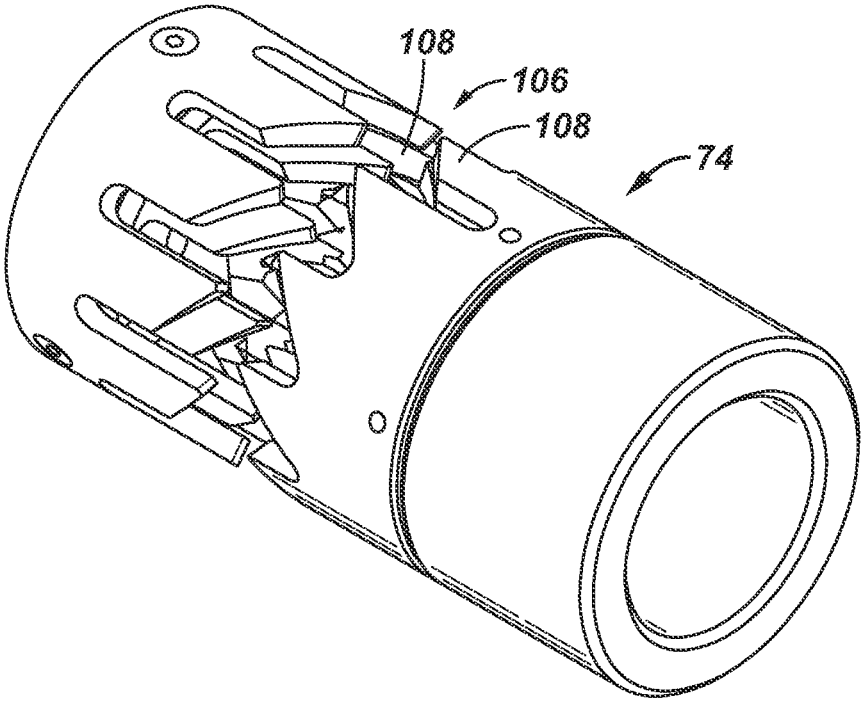
FIG. 12 is an orthogonal view of the alternate indexing mechanism illustrated in FIG. 10, according to an embodiment of the disclosure.

Another example of indexing mechanism 70 is illustrated in FIGS. 10-12. In this embodiment, the indexing mechanism 70 comprises a plurality of concentric J-slot mechanisms 106 formed on concentric annular rotors 108 (see FIG. 12). The examples of indexing mechanisms 70 illustrated in FIGS. 4-12 can be used with a variety of configurations of dart 38 to control the number of indexing mechanism actuations required to move the locking member 90 or other feature against engagement member 46, thus actuating the engagement member 46. Additionally, the various embodiments are amenable for use with different numbers of flow control devices 34 disposed along the completion 22.

For example, in a system with two or more J-slot rotors, the number of positions can be chosen such that their J-slot numbers share as few common factors as possible. In the case of two rotors with one pin each, 10 positions is feasible for a tool that fits in, for example, 4" casing. Based on this, 9 and 10 position J-slots provide the largest number of possible positions; 90. If 10 and 5 were chosen, there would only be 10 possibilities, as the 5 slot rotor would come into alignment with the 10 slot twice more often than other numbers. Basically, the number of sliding sleeves/flow control devices is equal to the Least Common Multiple of Rotor A and Rotor B positions, as set forth below:

| Rotor A positions | Rotor B positions | Number of sleeves |
|---|---|---|
| 10 | 10 | 10 |
| 10 | 9 | 90 |
| 10 | 8 | 40 |
| 10 | 7 | 70 |
| 10 | 6 | 30 |
| 10 | 5 | 10 |
| 10 | 4 | 20 |
| 10 | 3 | 30 |
| 10 | 2 | 10 |

It should be noted that rotors with too few positions may require either longer stroke or steeper angles which can lead to un-reliable operation or excessive friction.

An extension of double-J-slot systems is a triple-J-slot system. Hundreds of sliding sleeves can be employed using a triple-J-slots system. Again, assuming a maximum of 10 positions on each Rotor and Rotor A has 10 positions, the list below provides the possible scenarios. In this example, the number of sliding sleeves is equal to the Least Common Multiple of the Rotor A (assumed to be 10 here), Rotor B (the first column on the left), and Rotor C (the first row on the top) positions, as set forth in the table below. A good choice of common factors tends to be the combination of 10, 9, and 7 positions, which leads to a total number of 630 sleeves. Notice that the table below is symmetric, which means that the number of resulting sleeves is independent of the positioning of Rotors A, B, and C. In fact, if an 11 positions rotor is used, then the combination of 11, 10, and 9 positions rotors can be used to provide 11*10*9=990 sliding sleeves/flow control devices.

| | 10 | 9 | 8 | 7 | 6 | 5 | 4 | 3 | 2 |
|---|---|---|---|---|---|---|---|---|---|
| 10 | 10 | 90 | 40 | 70 | 30 | 10 | 20 | 30 | 10 |
| 9 | 90 | 90 | 360 | 630 | 90 | 90 | 180 | 90 | 90 |
| 8 | 40 | 360 | 40 | 280 | 120 | 40 | 40 | 120 | 40 |
| 7 | 70 | 630 | 280 | 70 | 210 | 70 | 140 | 210 | 70 |
| 6 | 30 | 90 | 120 | 210 | 30 | 30 | 60 | 30 | 30 |
| 5 | 10 | 90 | 40 | 70 | 30 | 10 | 20 | 30 | 10 |
| 4 | 20 | 180 | 40 | 140 | 60 | 20 | 20 | 60 | 20 |
| 3 | 30 | 90 | 120 | 210 | 30 | 30 | 60 | 30 | 30 |
| 2 | 10 | 90 | 40 | 70 | 30 | 10 | 20 | 30 | 10 |

One structural challenge may be the mechanical AND gate formed by the multi-J-slot system having positions in which only one J-pin is holding the system load. In applications experiencing higher system loads, however, two or more pins may be employed to provide a mechanically stronger system. Stronger systems may lead to fewer possible sliding sleeves (if the pins align with the release slots once and only once per revolution however, it should have no influence on the number of sleeves, compared with the corresponding single-pin-single-release configuration). In many applications, the rotor release slots and pins are arranged in a pattern such that they only line up once per revolution and are also spaced such that no more than one pin aligns with a release slot at any one time.

| Pin | 1 | 2 | 3 | 4 | 5 | 6 | 7 | 8 | 9 | 10 | 11 |
|---|---|---|---|---|---|---|---|---|---|---|---|
| 222 | 111 | 0 | 0 | 0 | 0 | 0 | 111 | 0 | 0 | 0 | 0 |
| | 0 | 111 | 0 | 0 | 0 | 0 | 0 | 111 | 0 | 0 | 0 |
| | 0 | 0 | 111 | 0 | 0 | 0 | 0 | 0 | 111 | 0 | 0 |
| | 0 | 0 | 0 | 111 | 0 | 0 | 0 | 0 | 0 | 111 | 0 |
| | 0 | 0 | 0 | 0 | 111 | 0 | 0 | 0 | 0 | 0 | 111 |
| 222 | 111 | 0 | 0 | 0 | 0 | 111 | 0 | 0 | 0 | 0 | 0 |
| | 0 | 111 | 0 | 0 | 0 | 0 | 111 | 0 | 0 | 0 | 0 |
| | 0 | 0 | 111 | 0 | 0 | 0 | 0 | 111 | 0 | 0 | 0 |
| | 0 | 0 | 0 | 111 | 0 | 0 | 0 | 0 | 111 | 0 | 0 |
| | 0 | 0 | 0 | 0 | 111 | 0 | 0 | 0 | 0 | 111 | 0 |
| | 0 | 0 | 0 | 0 | 0 | 111 | 0 | 0 | 0 | 0 | 111 |

An example of such as pattern is an eleven position rotor with two pins. In the chart above the pins are shown as 222. As the rotor with two slots 111 rotates through its eleven positions, the two pins and slots only line up once, and no less than one pin is always caught. An alternate example is illustrated in the chart below.

| Pin | 1 | 2 | 3 | 4 | 5 | 6 | 7 | 8 | 9 | 10 | 11 |
|---|---|---|---|---|---|---|---|---|---|---|---|
| 333 | 111 | 0 | 0 | 0 | 0 | 0 | 111 | 0 | 0 | 0 | 0 |
| | 0 | 111 | 0 | 0 | 0 | 0 | 0 | 111 | 0 | 0 | 0 |
| | 0 | 0 | 111 | 0 | 0 | 0 | 0 | 0 | 111 | 0 | 0 |
| | 0 | 0 | 0 | 111 | 0 | 0 | 0 | 0 | 0 | 111 | 0 |
| 333 | 0 | 0 | 0 | 0 | 111 | 0 | 0 | 0 | 0 | 0 | 111 |
| | 111 | 0 | 0 | 0 | 0 | 111 | 0 | 0 | 0 | 0 | 0 |
| | 0 | 111 | 0 | 0 | 0 | 0 | 111 | 0 | 0 | 0 | 0 |
| | 0 | 0 | 111 | 0 | 0 | 0 | 0 | 111 | 0 | 0 | 0 |
| 333 | 0 | 0 | 0 | 111 | 0 | 0 | 0 | 0 | 111 | 0 | 0 |
| | 0 | 0 | 0 | 0 | 111 | 0 | 0 | 0 | 0 | 111 | 0 |
| | 0 | 0 | 0 | 0 | 0 | 111 | 0 | 0 | 0 | 0 | 111 |

If three pins and slots are used as illustrated in the chart above, the arrangement may be constructed so that two pins are always in contact with the J-slot. The combination of 10 positions and three pins is also suitable for a variety of applications. It should be noted that there may be a point of diminishing returns where the number of slots gets high enough, e.g. around half the number of positions.

The concentric J-slots mechanism described above also may be capable of benefitting from multiple pins. However, the choices for the number may be further restricted if the pins reach into both rotors. In some applications, however, it may be desirable to use multiple pins on the outside rotor. To reach both rotors, the number of positions shares a common factor.

In a variety of indexer configurations, the J-pins are dimensioned such that the impact energy required to shear them is higher than the energy carried by the moving mass. The pins may be round or they may have flats on them to improve the contact pressure distribution as they touch the J-slots. In some applications, longer pins are used to increase the contact area, to reduce contact stress, and thus to reduce impact damage on J-slot rotors.

Figure 13:
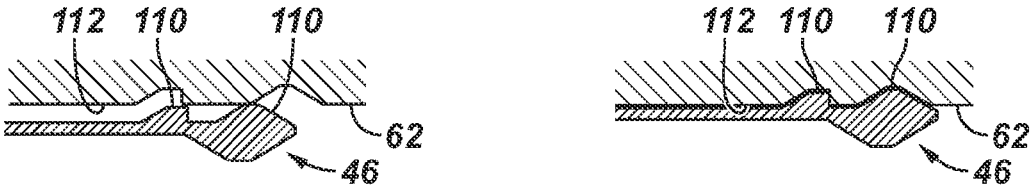
FIG. 13 is a cross-sectional view of a mechanical dart engagement member, according to an alternate embodiment of the disclosure.
Figure 14:
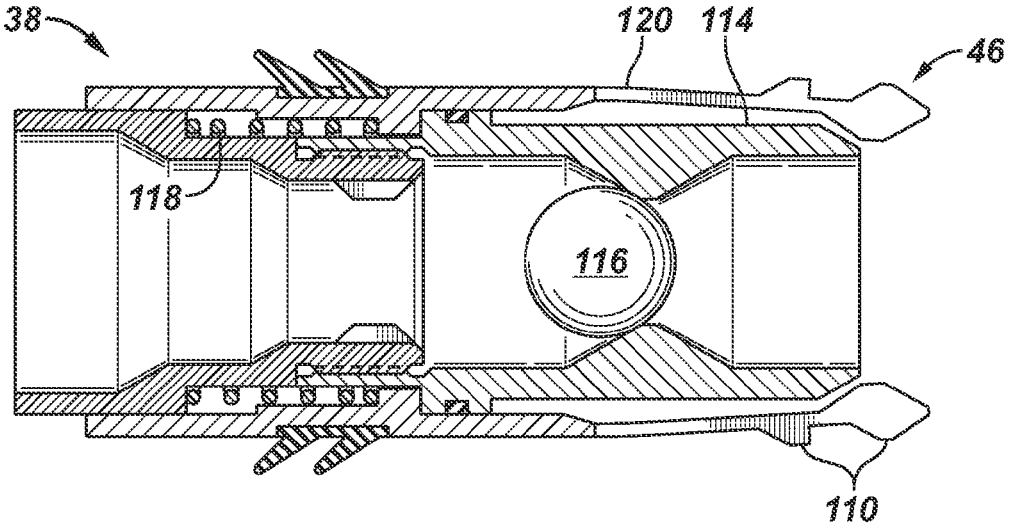
FIG. 14 is a cross-sectional view of an alternate example of a mechanical dart utilizing the engagement member illustrated in FIG. 13, according to an embodiment of the disclosure.
Figure 15:
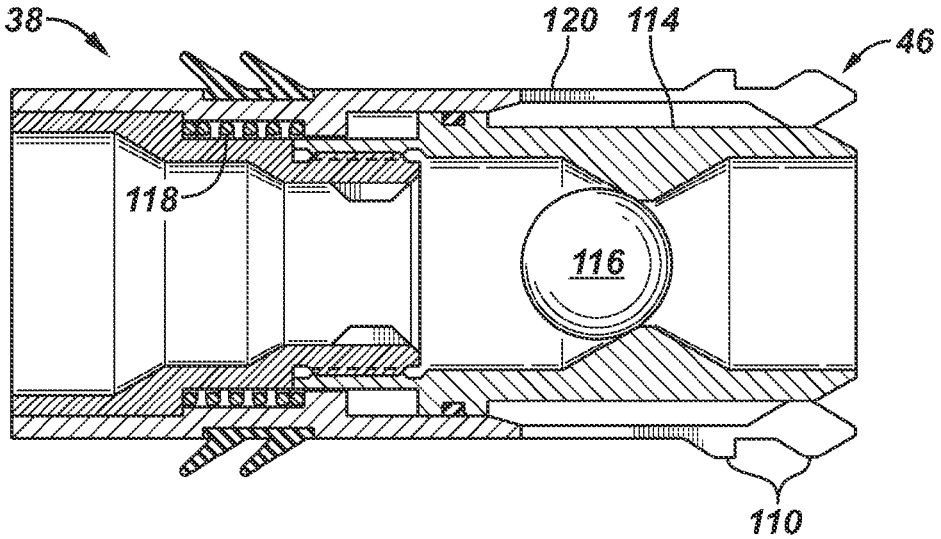
FIG. 15 is a cross-sectional view similar to that of FIG. 14 but showing the mechanical dart in a different operational position, according to an embodiment of the disclosure.

Referring generally to FIGS. 13-15, an alternate dart configuration is illustrated. In this embodiment, each dart 38 is designed so that the engagement feature 46 has an external profile 110 which is unique to each dart 38. The external profile 110 is designed to match an internal profile 112 of, for example, the corresponding sliding sleeve 62. If the external profile 110 does not match the internal profile 112, the dart 38 may be moved past the flow control device 34 until the dart reaches a flow control device having a sliding sleeve 62 with an internal profile 112 matching the external profile 110 of the engagement feature 46. In FIG. 13, the upper illustration of engagement feature 46 has an external profile 110 which does not match internal profile 112; and the lower illustration of engagement feature 46 has an external profile 110 which matches the internal profile 112.

The actual design of dart 38 may vary, but the embodiment illustrated in FIGS. 14 and 15 uses a locking member or ring 114 which is forced along an interior of engagement feature 46 when external profile 110 matches internal profile 112. As best illustrated in FIG. 15, once external profile 110 engages internal profile 112, pressure applied against a ball 116 drives the locking member 114 against the resistance of a spring member 118. The locking member 114 is moved against engagement feature 46 to prevent disengagement of external profile 110 from internal profile 112. In this example, the ball 116 may again cooperate with the surrounding annular member, e.g. locking member 114, to serve as a check valve which allows flow back of fluid. As with previous embodiments, the engagement feature 46 may be mounted on a collet 120 or other suitable mechanism which enables radial movement of the engagement feature 46.

The system and methodology described herein may be employed in non-well related applications which require actuation of devices at specific zones along a tubular structure. Similarly, the system and methodology may be employed in many types of well treatment applications and other applications in which devices are actuated downhole via dropped darts without requiring any changes to the diameter of the internal fluid flow passage. Different well treatment operations may be performed at different well zones without requiring separate interventions operation. Sequential darts may simply be dropped into engagement with specific well devices for actuation of those specific well devices at predetermined locations along the well equipment positioned downhole.

Although only a few embodiments of the system and methodology have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A method of treating a plurality of well zones, comprising:

providing each flow control device of a plurality of flow control devices with an internal profile and a flow through passage, wherein the internal profiles are unique relative to each other;

locating the plurality of flow control devices along a casing in a well bore; and selecting a plurality of mechanical darts constructed for engagement with the internal profiles of specific flow control devices of the plurality of flow control devices such that each of the mechanical darts corresponds to a different specific flow control device;

mechanically pre-setting each mechanical dart for actuation immediately prior to engagement with the internal profile of the specific flow control device corresponding to the mechanical dart;

dropping each mechanical dart of the plurality of mechanical darts for engagement with the internal profile of the specific flow control device corresponding to the mechanical dart; and for at least one of the dropped mechanical darts, creating a fluid barrier via engagement with the internal profile of the corresponding specific flow device for enabling a stimulation operation.

2. The method as recited in claim 1, wherein providing comprises providing a plurality of sliding sleeves.

3. The method as recited in claim 1, wherein providing comprises providing the flow through passages of the flow control devices with the same diameter.

4. The method as recited in claim 1, wherein selecting comprises constructing each mechanical dart of the plurality of mechanical darts with a check valve oriented to allow fluid flow back through the flow through passage.

5. The method as recited in claim 1, wherein selecting comprises constructing each mechanical dart of the plurality of mechanical darts with an indexer arranged to index as the mechanical dart passes through each flow control device until the indexer actuates the mechanical dart into engagement with the specific flow control device corresponding to that mechanical dart.

6. The method as recited in claim 5, wherein constructing comprises constructing the indexer as a J-slot indexer.

7. The method as recited in claim 5, wherein constructing comprises constructing the indexer as a single J-slot indexer.

8. The method as recited in claim 5, wherein constructing comprises constructing the indexer as a double J-slot indexer.

9. The method as recited in claim 5, wherein constructing comprises constructing the indexer as a spline indexer.

10. The method as recited in claim 5, wherein constructing comprises constructing the indexer as a concentric J-slot indexer.

11. A system for use in treating a well, comprising:

a plurality of flow control devices, wherein each flow control device has a flow through passage and an internal profile, and the internal profiles are unique relative to each other;

a dart having an engagement member shaped to engage a given internal profile of the internal profiles, the dart further comprising an indexing mechanism which mechanically indexes each time the dart passes through one of the flow control devices, the indexing mechanism actuating to secure the engagement member in sealing engagement with the given internal profile to create a fluid barrier at the flow control device having the given internal profile after passing through at least one other flow control device of the flow control devices.

12. The system as recited in claim 11, wherein the dart further comprises an external seal packing.

13. The system as recited in claim 11, wherein the dart further comprises an internal check valve.

14. The system as recited in claim 11, wherein the engagement member is part of a collet.

15. The system as recited in claim 11, wherein the dart further comprises a locking member positioned to lock the engagement member against the internal profile.

16. The system as recited in claim 11, wherein the dart further comprises an indexing sleeve engaging an indexing pin extending from a surrounding dart housing.

17. A method, comprising:

deploying a multizone well stimulation system into a wellbore with a plurality of flow control devices;

providing each dart of a plurality of darts with a mechanical actuation system which is mechanically manipulated via passage through the multizone well stimulation system to actuate the dart into engagement with a predetermined flow control device of the plurality of flow control devices, thus enabling actuation of the predetermined flow control device to a different operational position, wherein providing comprises providing each dart with a mechanical indexer which is indexed each time the dart passes a flow control device as the dart moves through the multizone well stimulation system; and dropping individual darts into the multizone well stimulation system for engagement with the predetermined flow control device associated with the individual dart, wherein dropping comprises moving a first dart into operational engagement with the flow control device located furthest downhole in the wellbore; treating a surrounding well zone; moving a second dart into operational engagement with the next sequential flow control device; treating a well zone surrounding the next sequential flow control device; and repeating the process of moving darts into operational engagement with sequential flow control devices and treating the sequential, surrounding well zones until the desired number of well zones has been treated.

* * * * *